US005468924A

United States Patent [19]

Naitou et al.

[11] Patent Number: 5,468,924

[45] Date of Patent: Nov. 21, 1995

[54] JOY STICK SUPPORT STRUCTURE FOR MULTI-DIRECTIONAL SWITCH

[75] Inventors: Kiyotaka Naitou; Junichi Kojima, both of Yokkaichi, Japan

[73] Assignee: Sumitomo Wiring Systems, Ltd., Japan

[21] Appl. No.: 254,927

[22] Filed: Jun. 7, 1994

[30] Foreign Application Priority Data

Jul. 1, 1993 [JP] Japan ..... 5-190790
Sep. 13, 1993 [JP] Japan ..... 5-054760 U

[51] Int. Cl.[6] ..... H01N 25/04

[52] U.S. Cl. ..... 200/6 A; 74/471 X Y

[58] Field of Search ..... 200/1 B, 5 R, 200/5 A, 6 A, 512–517, 339, 553, 557, 293–307; 74/471 X Y

[56] References Cited

U.S. PATENT DOCUMENTS

| | | | |
|---|---|---|---|
| 3,033,946 | 5/1962 | Meyer et al. | 200/6 A |
| 4,349,708 | 9/1982 | Asher | 200/6 A |
| 4,408,103 | 10/1983 | Smith, III | 200/6 A |
| 4,469,330 | 9/1984 | Asher | 273/148 B |
| 4,687,200 | 8/1987 | Shirai | 273/148 B |
| 4,992,631 | 2/1991 | Gee | 200/6 A X |
| 5,087,798 | 2/1992 | Rohde et al. | 200/5 A |
| 5,089,677 | 2/1992 | Satou | 200/339 |
| 5,115,108 | 5/1992 | Ogawa et al. | 200/1 B |
| 5,294,121 | 3/1994 | Chiang | 200/5 A X |

FOREIGN PATENT DOCUMENTS

| | | | |
|---|---|---|---|
| 2810609 | 9/1978 | Germany | H01H 25/04 |
| 57-128731 | 2/1981 | Japan | H01H 25/04 |
| 1-111431 | 7/1989 | Japan | H01H 25/04 |

*Primary Examiner*—J. R. Scott
*Attorney, Agent, or Firm*—Jordan B. Bierman; Bierman and Muserlian

[57] ABSTRACT

A multi-directional switch (1) comprises a joy stick (6) which is inclined for selective operation of a plurality of switch portions. The joy stick (6) includes a support portion (6*a*) supported pivotally about the bottom end thereof; a slidable contact spherical portion (6*b*) bulging from the top end of the support portion (6*a*) and having a spherical surface (6*e*) slidably abutting throughout the circumference thereof against the inner peripheral surface of a through hole (5*a*) when pivoted; and an operating portion (6*c*) projecting through the through hole (5*a*) adjacent the spherical surface (6*e*). The outer periphery of a flat surface (6*d*) of the slidable contact spherical portion (6*b*) of the joy stick (6) is supported at four circumferentially spaced positions so that the joy stick (6) is returned to a neutral position by the elastic restoring force of the switch portions. A joy stick support structure for the multi-directional switch (1) requires neither a particularly part for returning the joy stick (6) to the neutral position nor a securely determined fulcrum.

12 Claims, 4 Drawing Sheets

JOY STICK SUPPORT STRUCTURE FOR MULTI-DIRECTIONAL SWITCH

BACKGROUND OF THE INVENTION

1. Field of the Invention

The present invention relates to a joy stick support structure for a multi-directional switch for selectively controlling a plurality of switch portions.

2. Description of the Prior Art

This type of multi-directional switch is disclosed in Japanese Utility Model Application Laid-Open No. 57-128731 (1982) and Japanese Utility Model Application Laid-Open No. 1-111431 (1989), for example. The prior art multi-directional switch includes four switch portions formed on a printed wiring board or the like, a joy stick supported pivotally about a pivot fulcrum located centrally of the four switch portions, and a spring element such as a coil spring and a plate spring for returning the joy stick to its neutral position. An operating portion of the joy stick which projects from a through hole of a panel is inclined against the elastic force of the spring element, to incline the joy stick. One of the switch portions is selectively turned into the on position by the joy stick, depending on the direction of the inclination. When the operating force exerted upon the joy stick is released, the elastic force accumulated in the spring element forces the joy stick to return to the neutral position, and the one switch portion is returned to the off position by the restoring force thereof.

The above-mentioned prior art multi-directional switch structure, however, is of the type wherein the joy stick is returned to the neutral position by the spring element such as a coil spring and a plate spring. In this structure, it is necessary to securely determine the pivot fulcrum of the joy stick so that the joy stick is returned to the neutral position spaced from the switch portions, resulting in an increased number of parts and deterioration in productivity.

Further, an additional spring element such as a coil spring and a plate spring is required to return the joy stick to the neutral position, which results in an increased number of parts and the increased total size of the structure.

SUMMARY OF THE INVENTION

The present invention is intended for a joy stick support structure for a multi-directional switch, the multi-directional switch including a plurality of switch portions released and restored by an elastic restoring force, a joy stick having an operating portion and supported returnably to a neutral position, the joy stick being inclined by the operating portion to selectively operate the plurality of switch portions, and a cover panel for covering the switch portions and having a through hole through which the operating portion projects. According to the present invention, the joy stick comprises a support portion supported pivotally about one end thereof adjacent the switch portions of the multi-directional switch, a slidable contact spherical portion bulging from the other end of the support portion and having a spherical surface slidably abutting throughout the entire circumference thereof against an inner peripheral surface of the through hole when pivoted, the operating portion projecting from the spherical surface. An outer periphery of the slidable contact spherical portion adjacent the support portion is supported in at least three circumferentially spaced positions so that the joy stick is returned to the neutral position by the elastic restoring force of the switch portions.

According to the present invention, when the operating portion of the joy stick projecting through the through hole of the cover panel is pressed in a predetermined direction, the joy stick is inclined about one end of the support portion. The inclination of the joy stick permits the slidable contact spherical portion to selectively switch on a desired switch portion.

When the operating force exerted upon the joy stick is released, the slidable contact spherical portion is pressed back by the elastic restoring force of the switch portion which is on, and the joy stick is then returned to the neutral position and the switch portion is switched off. Thus, there is no need to provide an additional member for returning the joy stick to the neutral position, thereby permitting reduction in the number of parts and facilitating the structure. This provides for cost reduction, space reduction, and improvement in productivity.

Further, the through hole of the cover panel is constantly covered with the spherical surface of the slidable contact spherical portion slidably abutting thereagainst during the inclination of the joy stick, requiring no parts for concealing the interior of the switch and effectively preventing dust from entering the interior of the switch.

In another aspect of the present invention, the cover panel comprises at least three point contact support projections formed in circumferentially spaced relation on an inner peripheral surface of the through hole. The joy stick comprises a support portion supported pivotally about one end thereof adjacent the switch portions of the multi-directional switch, a slidable contact spherical portion bulging from the other end of the support portion and having a spherical surface in point contact with the point contact support projections, the spherical surface being slidable in point contact with the point contact support projections when pivoted, the operating portion projecting from the spherical surface. An outer periphery of the slidable contact spherical portion adjacent the support portion is supported in at least three circumferentially spaced positions so that the joy stick is returned to the neutral position by the elastic restoring force Of the switch portions.

The slidable contact spherical portion of the joy stick slides in point contact with the point contact support projections formed on the inner peripheral surface of the through hole of the cover panel during the inclination of the joy stick. Thus, the frictional resistance is very small at the contact between the joy stick and the cover panel, and the joy stick is smoothly inclined, thereby providing a good operating feeling.

It is a primary object of the present invention to provide a joy stick support structure for a multi-directional switch which requires neither a particular part for returning a joy stick to its neutral position nor a securely determined fulcrum of the joy stick.

It is another object of the present invention to provide a joy stick support structure for a multi-directional switch which provides a good operating feeling.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
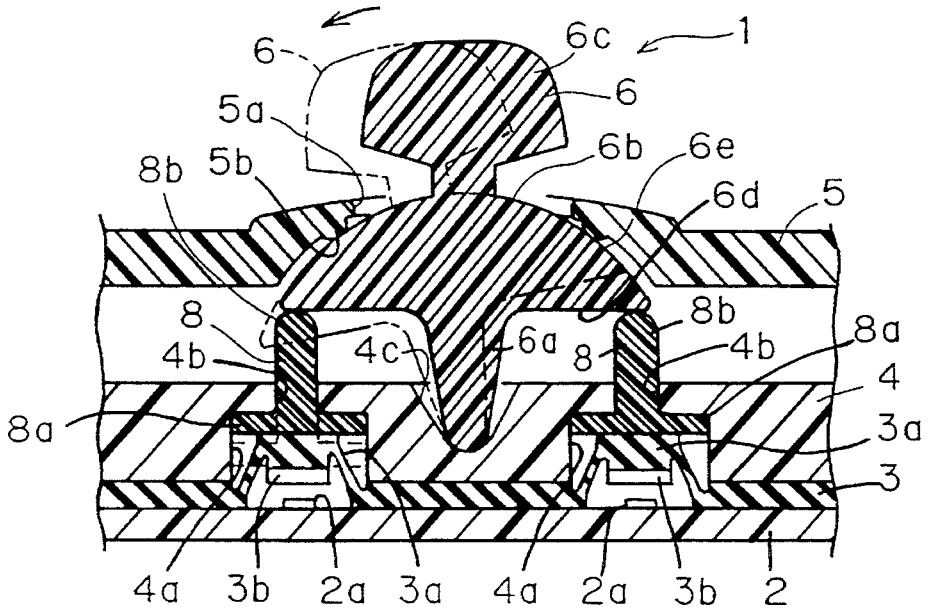
FIG. 1 is a sectional view of principal parts of a first preferred embodiment according to the present invention.
Figure 2:
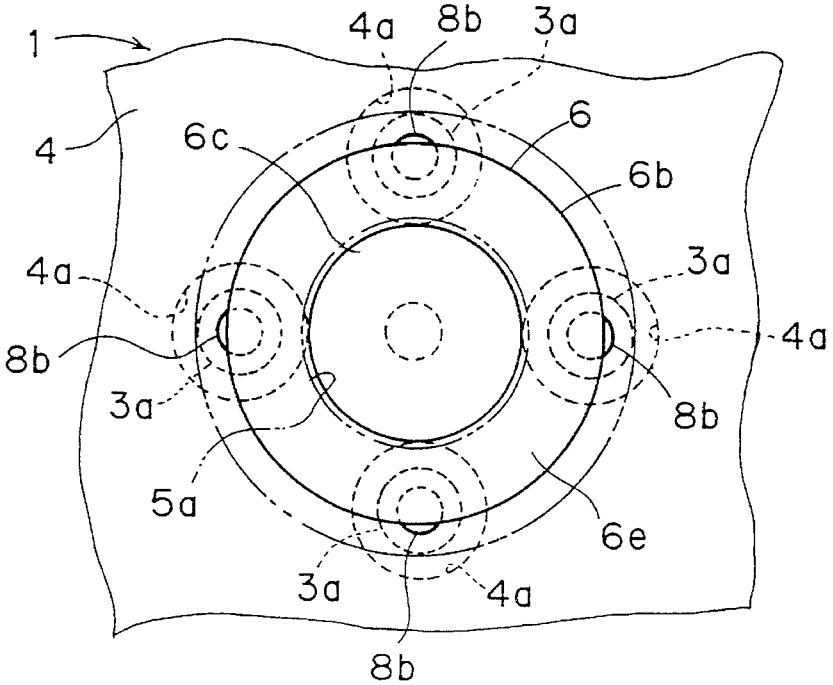
FIG. 2 is a plan view of the principal parts of the first preferred embodiment, with a cover panel omitted.

A first preferred embodiment according to the present invention will now be described hereinafter, with reference to the drawings. As shown in FIGS. 1 and 2, a multi-directional switch 1 comprises a printed wiring board 2 having a suitably formed wiring pattern, a rubber contact switch sheet 3 made of a rubber material or the like and including elastically deformable contact switch portions 3*a*, a guide plate 4, a cover panel 5, and a joy stick 6. The elements 4, 5 and 6 are made of a synthetic resin or the like.

The rubber contact switch sheet 3 includes the four bulging contact switch portions 3*a* constantly spaced in a circumferential direction of a circle having a desired diameter. As shown in FIG. 1, the rubber contact switch sheet 3 is superposed upon the printed wiring board 2 so that the contact switch portions 3*a* project upwardly.

Contacts 2*a* of the printed wiring board 2 and contacts 3*b* of the contact switch portions 3*a* are opposed to each other in vertically suitably spaced relation. The respective contacts 2*a* and 3*b* form a plurality of freely connectable/disconnectable switch portions.

The guide plate 4 is superposed upon the rubber contact switch sheet 3, as shown in FIG. 1. Vertical circular recesses 4*a* are formed in a lower surface of the guide plate 4 in corresponding relation to the contact switch portions 3*a* to house the contact switches 3*a*, respectively. The guide plate 4 further includes vertical guide holes 4*b* formed therethrough at the center of the bottom of the respective circular recesses 4*a*.

Cooperating rods 8 each includes a disc portion 8*a* vertically slidably guided along the inner peripheral surface of the corresponding circular recess 4*a*, and a guide rod 8*b* vertically slidably guided along the inner peripheral surface of the corresponding guide hole 4*b*. The disc portions 8*a* are disposed on the upper surface of the contact switch portions 3*a*, and the guide rods 8*b* project upwardly from the guide holes 4*b*, respectively. Each of the guide rods 8*b* of the cooperating rods 8 has a hemispherical top end.

The guide plate 4 further includes a fulcrum recess 4*c* in the upper surface thereof at the center of the circular recesses 4*a*.

The joy stick 6 includes a support portion 6*a*, a slidable contact spherical portion 6*b*, and an operating portion 6*c*, which are disposed coaxially in this order, as shown in FIG. 1. The bottom end of the support portion 6*a* is received in the fulcrum recess 4*c* of the guide plate 4 serving as a body, and the joy stick 6 is supported pivotally about the received bottom end of the support portion 6*a*.

The slidable contact spherical portion 6*b* bulges from the top end of the support portion 6*a*. The lower end surface of the slidable contact spherical portion 6*b* includes a flat surface 6*d* perpendicular to the axis of the support portion 6*a* and is of circular configuration about the axis of the support portion 6*a*. The upper surface of the slidable contact spherical portion 6*b* includes a spherical surface 6*e* centered on the pivot center at the bottom end of the support portion 6*a*. Thus, the slidable contact spherical portion 6*b* is of a so-called hemispherical configuration.

Figure 3:
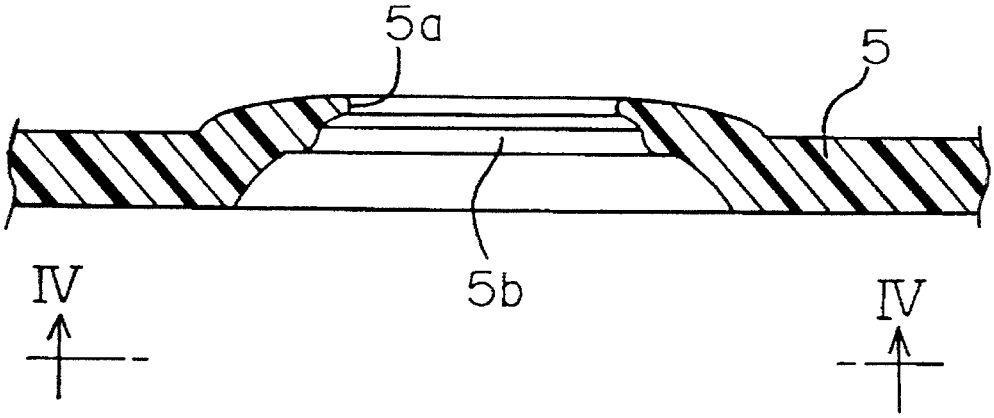
FIG. 3 is a sectional view of principal parts of the cover panel of the first preferred embodiment.
Figure 4:
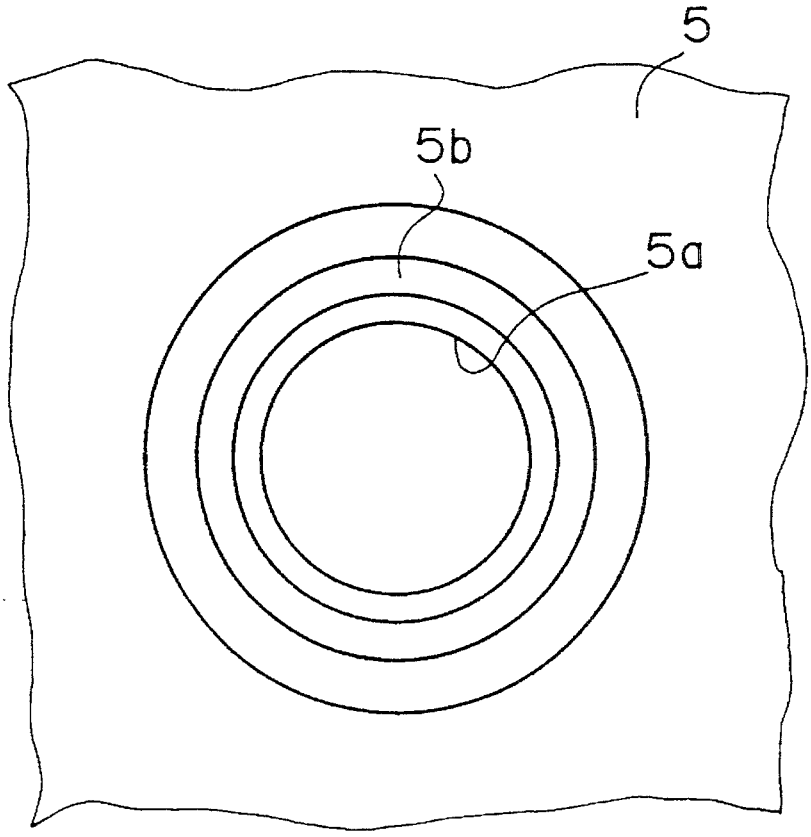
FIG. 4 is a view taken in the direction of the arrows IV—IV of FIG. 3.

The outer periphery of the flat surface 6*d* is urged upwardly and supported at circumferentially equally spaced positions by the elastic restoring force of the contact switch portions 3*a* from the top ends of the guide rods 8 of the cooperating rods 8. The spherical surface 6*e* slidably abuts throughout the entire circumference thereof against a circumferentially continuous, circular ledge 5*b* formed on the inner peripheral surface of a circular through hole 5*a* of the cover panel 5, as shown in FIGS. 3 and 4.

The operating portion 6*c* at the center of the spherical surface 6*e* projects upwardly through the through hole 5*a* of the cover panel 5 for covering the guide plate 4, the cooperating rods 8, and the joy stick 6.

In the above-stated first preferred embodiment of the present invention, the joy stick 6 is adapted such that the outer periphery of the flat surface 6*d* is urged upwardly at the circumferentially equally spaced positions by the elastic restoring force of the contact switch portions 3*a* through the cooperating rods 8, and the spherical surface 6*e* of the joy stick 6 abuts against the ledge 5*b* of the cover panel 5 by the urging force, thereby effectively preventing the joy stick 6 from being unsteady.

As shown in phantom in FIG. 1, when the operating portion 6*c* of the joy stick 6 is pushed leftwardly, the joy stick 6 is inclined about the bottom end of the support portion 6*a* serving as the fulcrum. During the inclination of the joy stick 6, the support recess 4*c* receives and supports the bottom end of the support portion 6*a* of the joy stick 6. The structure of the first preferred embodiment is of the type wherein the joy stick 6 is inclined under the urging force of at least one of the contact switch portions 3*a*. The spherical surface 6*e* of the slidable contact spherical portion 6*b* constantly slides along the ledge 5*b* of the cover panel 5. This provides a stable operating feeling without a securely determined fulcrum.

The inclination of the joy stick 6 causes the outer periphery of the flat surface 6*d* of the slidable contact spherical portion 6*b* to press one of the cooperating rods 8 downwardly under guidance of the corresponding guide hole 4*b*. Then the corresponding contact switch portion 3*a* is pressed downwardly against the elastic force thereof by the corresponding disc portion 8a of the operating rod 8, and the corresponding contacts 2*a* and 3*b* come in contact with each other into the on position.

When the operating force exerted upon the joy stick 6 is released, the elastic restoring force of the contact switch portion 3*a* which is on forces the corresponding cooperating rod 8 upwardly, which in turn causes the corresponding guide rod 8*b* of the cooperating rod 8 to press back the slidable contact spherical portion 6*b*. Then the joy stick 6 is returned to the initial neutral position, and the corresponding contacts 2*a* and 3*b* are separated from each other to return the corresponding contact switch portion 3*a* to the off position.

As above described, since the structure of the first preferred embodiment is of the type wherein the joy stick 6 is returned to the neutral position by the elastic restoring force of the respective contact switch portions 3*a*, there is no need to provide an additional member for returning the joy stick 6 to the neutral position such as the prior art coil spring or plate spring. Further, it is unnecessary to securely determine the fulcrum of the joy stick 6, which provides for reduction in the number of parts and, accordingly, facilitates the structure. This permits cost reduction, space reduction, and improvement in productivity.

Further, the spherical surface 6*e* of the slidable contact spherical portion 6*b* of the joy stick 6 constantly covers the through hole 5*a* of the cover panel 5 in a closing manner during the inclination of the joy stick 6. This structure requires no parts for concealing the interior of the multi-directional switch 1 and effectively prevents dust from entering the interior of the multi-directional switch 1.

Although the structure includes the four switch portions in the first preferred embodiment, three or five switch portions may be provided, and the number of switch portions is not limited to that of the first preferred embodiment. The structure of the switch portions is not limited-to that of the first preferred embodiment, and various types of switch portions are applicable which are automatically restored by the elastic restoring force. Although the single switch portion is operated by the inclination of the joy stick 6 in the first preferred embodiment, a plurality of switch portions may be simultaneously operated.

Figure 5:
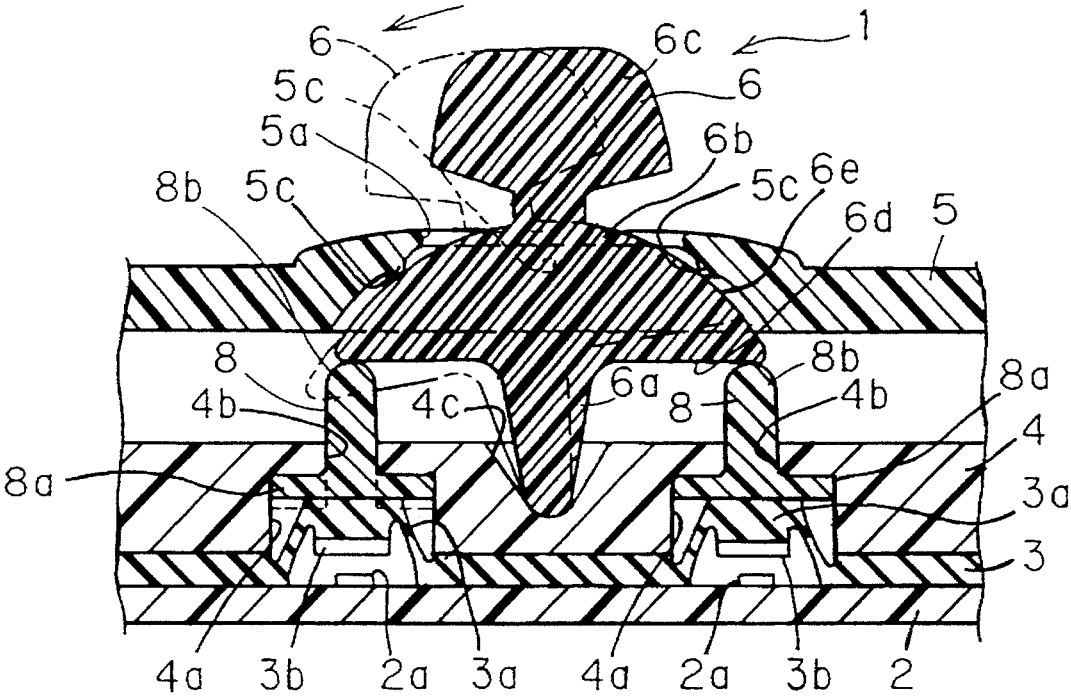
FIG. 5 is a sectional view of principal parts of a second preferred embodiment according to the present invention.
Figure 6:
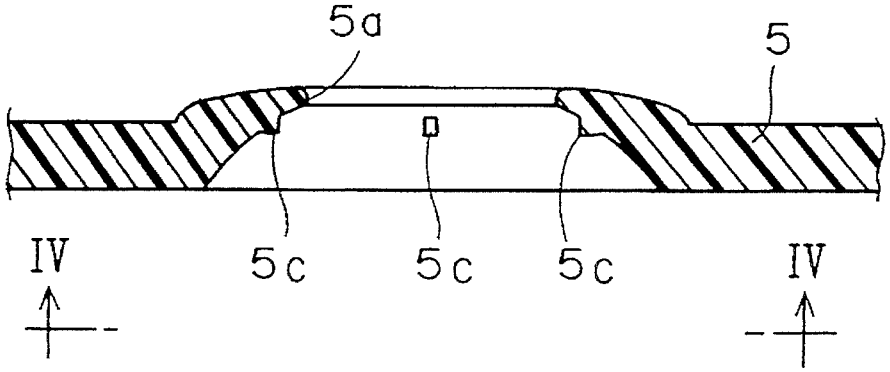
FIG. 6 is a sectional view of principal parts of the cover panel of the second preferred embodiment.
Figure 7:
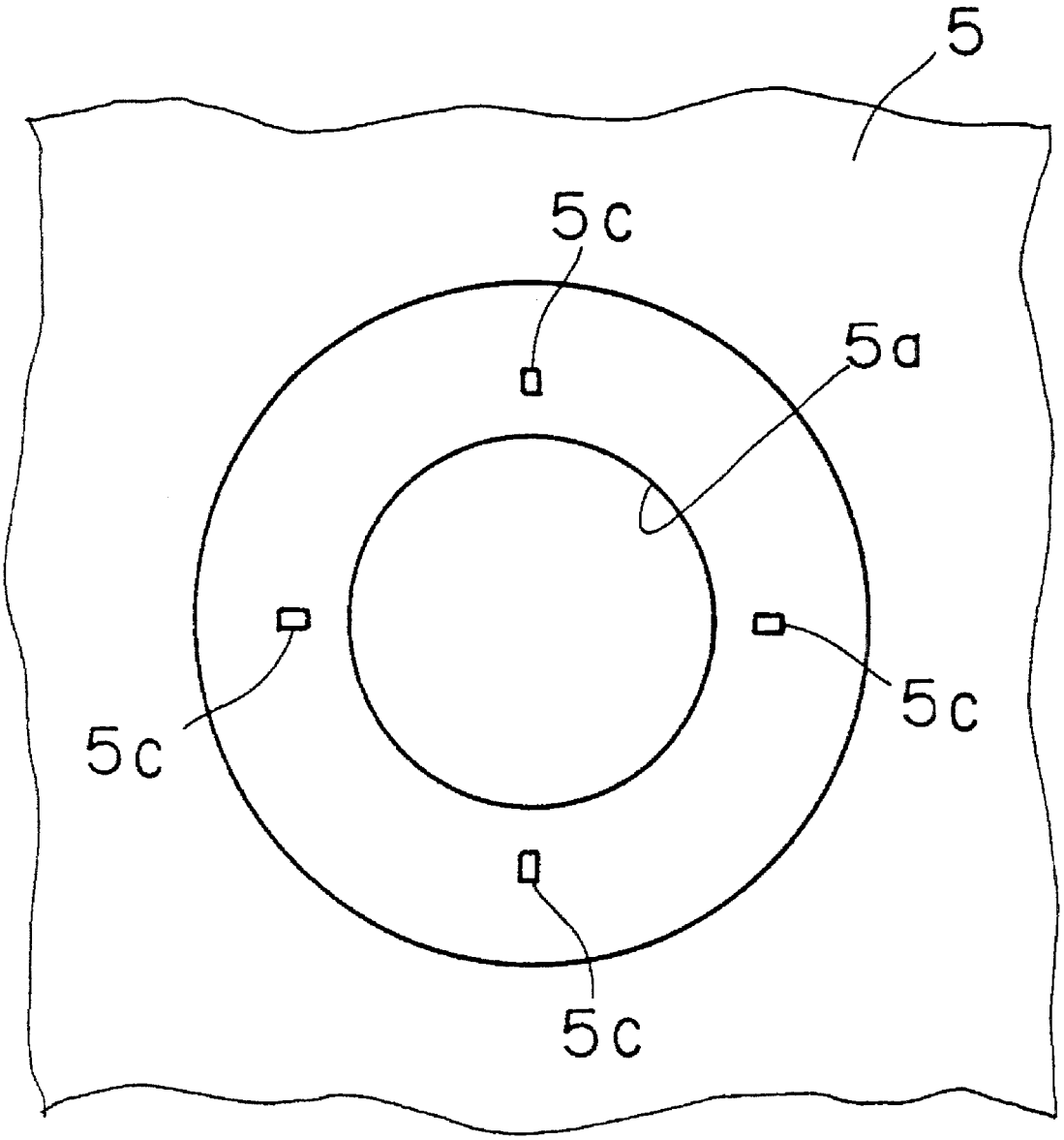
FIG. 7 is a view taken in the direction of the arrows VII—VII of FIG. 6.

Referring to FIGS. 5 to 7, a second preferred embodiment will be discussed hereinafter according to the present invention. Like reference numerals and characters are used to designate parts identical with those of the first preferred embodiment, and the description thereof will be omitted herein.

Similar to the first preferred embodiment, the joy stick 6 is adapted such that the outer periphery of the flat surface 6*d* is supported and urged upwardly at circumferentially equally spaced positions by the elastic restoring force of the contact switch portions 3*a* from the top ends of the guide rods 8*b* of the cooperating rods 8. The spherical surface 6*e* is in point contact with and relatively slidably supported by four point contact support projections 5*c* formed in circumferentially equally spaced relation on the inner peripheral surface of the circular through hole 5*a* of the cover panel 5.

In the above-stated second preferred embodiment of the present invention, similar to the first preferred embodiment, the joy stick 6 is adapted such that the outer periphery of the flat surface 6*d* is urged upwardly at the circumferentially equally spaced positions by the elastic restoring force of the contact switch portions 3*a* through the respective cooperating rods 8, and the spherical surface 6*e* of the joy stick 6 abuts against the respective point contact support projections 5*c* by the urging force, thereby effectively preventing the joy stick 6 from being unsteady.

As shown in phantom in FIG. 5, when the operating portion 6*c* of the joy stick 6 is pushed leftwardly, the joy stick 6 is inclined about the bottom end of the support portion 6*a* serving as the fulcrum. During the inclination of the joy stick 6, the fulcrum recess 4*c* receives and supports the bottom end of the support portion 6*a* of the joy stick 6. The structure of the second preferred embodiment is of the type wherein the joy stick 6 is inclined under the urging force of at least one of the contact switch portions 3*a*. The spherical surface 6*e* of the slidable contact spherical portion 6*b* constantly slides in point contact with the respective point contact support projections 5*c* of the cover panel 5. This provides a stable operating feeling without the securely determined fulcrum.

The inclination of the joy stick 6 causes the outer periphery of the flat surface 6*d* of the slidable contact spherical portion 6*b* to press one of the cooperating rod 8 downwardly under guidance of the corresponding guide hole 4*b*. Then the corresponding contact switch portion 3*a* is forced downwardly against the elastic force thereof by the corresponding disc portion 8*a* of the cooperating rod 8, and the corresponding contacts 2*a* and 3*b* come in contact with each other into the on position.

When the operating force exerted upon the joy stick 6 is released, the elastic restoring force of the contact switch portion 3*a* which is on forces the corresponding cooperating rod 8 upwardly, which in turn causes the corresponding guide rod 8*b* of the cooperating rod 8 to press back the slidable contact spherical portion 6*b*. Then the joy stick 6 is returned to the initial neutral position, and the corresponding contacts 2*a* and 3*b* are separated from each other to return the corresponding contact switch portion 3*a* to the off position.

As above discussed, since the structure of the second preferred embodiment is of the type wherein the joy stick 6 is returned to the neutral position by the elastic restoring force of the respective contact switch portions 3*a*, there is no need to provide an additional member for returning the joy stick 6 to the neutral position such as the prior art coil spring or plate spring. Furthermore, it is unnecessary to securely determine the fulcrum of the joy stick 6, which provides for reduction in the number of parts and, accordingly, facilitate the structure. This permits cost reduction, space reduction, and improvement in productivity.

On the other hand, since the spherical surface 6*e* of the slidable contact spherical portion 6*b* slides in point contact with the respective point contact support projections 5*c* during the inclination of the joy stick 6, a frictional resistance is very small at the contact between the joy stick 6 and the cover panel 5. This provides smooth inclination of the joy stick 6 and a good operating feeling. The second preferred embodiment is less influenced by dust or powders made due to abrasion but provides a constantly stable, good operating feeling.

Although the structure includes the four switch portions in the second preferred embodiment, three or five switch portions may be provided, and the number of switch portions is not limited to that of the second preferred embodiment. Although the structure includes the four point contact support projections 5*c* in the second preferred embodiment, three or five point contact support projections may be provided, and the number of point contact support projections is not limited to that of the second preferred embodiment. The structure of the switch portions is not limited to that of the second preferred embodiment, and various types of switch portions are applicable which are automatically restored by the elastic restoring force. Although the single switch portion is operated by the inclination of the joy stick 6 in the second preferred embodiment, a plurality of switch portions may be simultaneously operated.

While the invention has been shown and described in detail, the foregoing description is in all aspects illustrative and not restrictive. It is therefore understood that numerous modifications and variations can be devised without departing from the scope of the invention.

What is claimed is:

1. A support structure for a joystick for a multidirectional switch, said switch comprising at least three circumferentially spaced switch portions, each of said switch portions comprising a first contact and a second contact, said multidirectional switch having a neutral position, wherein each said first contact and said second contact are separated from each other, and an actuating position, wherein at least one said first contact is in contact with a corresponding said second contact, said switch portions yieldably urging said joystick into said neutral position, inclination of said joystick selectively operating said switch portions, and a cover panel for covering said switch portions and having a through hole through which an operating portion of said joystick projects, said joystick comprising a support portion supported pivotally about one end thereof adjacent said switch portions, a slidable contact spherical portion bulging from the other end of said support portion and having a spherical surface slidably abutting, through at least part of its circumference, against an inner peripheral surface of said through hole when pivoted, said operating portion projecting from said spherical surface.

2. The support structure of claim 1, wherein said cover panel includes a ledge formed on the inner peripheral surface of said through hole and extending circumferentially throughout, and said spherical surface slidably abuts against said ledge.

3. The support structure of claim 1, wherein said plurality of switch portions are constantly spaced in a circumferential direction of a circle having a desired diameter.

4. The support structure of claim 3, wherein said cover panel includes a ledge formed on the inner peripheral surface of said through hole and extending circumferentially throughout, and said spherical surface slidably abuts against said ledge.

5. The support structure of claim 4 wherein said multi-directional switch includes a printed wiring board having a plurality of said first contacts, and a contact switch sheet superposed upon said printed wiring board and having a plurality of elastically deformable, bulging contact switch portions having said second contacts opposing said first contacts.

6. The support structure of claim 5, wherein said multi-directional switch further includes a guide plate superposed upon said contact switch sheet superposed upon said printed wiring board, and said guide plate includes circular recesses receiving the corresponding contact switch portions, respectively, and guide holes extending through said guide plate on the bottom of said circular recesses, respectively, wherein said multi-directional switch further includes cooperating rods having disc portions slidably guided along an inner peripheral surface of the corresponding circular recesses, and guide rods slidably guided along an inner peripheral surface of the corresponding guide holes, respectively, and wherein the outer periphery of said slidable contact spherical portion adjacent said support portion is supported by projecting ends of said guide rods of said cooperating rods urged by the elastic restoring force of said contact switch portions.

7. The support structure of claim 6, wherein said guide plate includes a fulcrum recess formed centrally of said switch portions in a surface thereof opposite to said contact switch sheet for pivotally supporting said support portion.

8. A support structure for a joystick for a multidirectional switch, said switch comprising at least three circumferentially spaced switch portions, each of said switch portions comprising a first contact and a second contact, said multi-directional switch having a neutral position, wherein each said first contact and said second contact are separated from each other, and an actuating position, wherein at least one said first contact is in contact with a corresponding said second contact, said switch portions yieldably urging said switch into said neutral position, inclination of said joystick selectively operating said switch portions, said cover panel comprising at least three point contact support projections formed in circumferentially spaced relation on an inner peripheral surface of said through hole, said joystick comprising a support portion supported pivotally about one end thereof adjacent said switch portions, a slidable contact spherical portion bulging from the other end of said support portion and having a spherical surface in point contact with said point contact support projections, said spherical surface being slidable in point contact with said point contact support projections when pivoted, said operating portion projecting from said spherical surface.

9. The support structure of claim 8, wherein said plurality of switch portions are constantly spaced in a circumferential direction of a circle having a desired diameter.

10. The support structure of claim 9 wherein said multi-directional switch includes a printed wiring board having a plurality of said first contacts, and a contact switch sheet superposed upon said printed wiring board and having a plurality of elastically deformable, bulging contact switch portions having said second contacts opposing said first contacts.

11. The joy stick support structure of claim 10, wherein said multi-directional switch further includes a guide plate superposed upon said contact switch sheet superposed upon said printed wiring board, and said guide plate includes circular recesses receiving the corresponding contact switch portions, respectively, and guide holes extending through said guide plate on the bottom of said circular recesses, respectively, wherein said multi-directional switch further includes cooperating rods having disc portions slidably guided along an inner peripheral surface of the corresponding circular recesses, and guide rods slidably guided along an inner peripheral surface of the corresponding guide holes, respectively, and wherein the outer periphery of said slidable contact spherical portion adjacent said support portion is supported by projecting ends of said guide rods of said cooperating rods urged by the elastic restoring force of said contact switch portions.

12. The support structure of claim 11, wherein said guide plate includes a fulcrum recess formed centrally of said switch portions in a surface thereof opposite to said contact switch sheet for pivotally supporting said support portion.

* * * * *